US011104022B2

(12) United States Patent
Park et al.

(10) Patent No.: US 11,104,022 B2
(45) **Date of Patent: *Aug. 31, 2021**

(54) UNITARY RAZOR BLADE AND SHAVING RAZOR CARTRIDGE USING SAME

(71) Applicant: DORCO CO., LTD., Seoul (KR)

(72) Inventors: Young Ho Park, Seoul (KR); Su Hwan Kim, Seoul (KR); Byung Sun Ahn, Seoul (KR)

(73) Assignee: DORCO CO., LTD., Seoul (KR)

( * ) Notice: Subject to any disclaimer, the term of this patent is extended or adjusted under 35 U.S.C. 154(b) by 164 days.

This patent is subject to a terminal disclaimer.

(21) Appl. No.: 16/533,433

(22) Filed: Aug. 6, 2019

(65) Prior Publication Data

US 2019/0358839 A1 Nov. 28, 2019

Related U.S. Application Data

(63) Continuation of application No. 15/845,331, filed on Dec. 18, 2017, now Pat. No. 10,486,322, which is a (Continued)

(30) Foreign Application Priority Data

Feb. 11, 2009 (KR) ..... 10-2009-0010877

(51) Int. Cl.
*B26B 21/56* (2006.01)
*B26B 21/28* (2006.01)

(52) U.S. Cl.
CPC ..... *B26B 21/565* (2013.01); *B26B 21/28* (2013.01)

(58) Field of Classification Search
CPC ..... B62B 21/28; B62B 21/4031; B62B 21/52; B62B 21/565
See application file for complete search history.

(56) References Cited

U.S. PATENT DOCUMENTS 1,924,262 A * 8/1933 Thompson ..... B26B 21/18 30/346.61
2,421,205 A * 5/1947 Kingsley ..... B26B 21/16 30/49

(Continued)

OTHER PUBLICATIONS

Intellectual Property Office of Brazil Application No. PI 1004000-5, Notice of Unfavorable Technical Opinion dated Jan. 9, 2020, 3 page.

*Primary Examiner* — Jonathan G Riley
(74) *Attorney, Agent, or Firm* — Lee, Hong, Degerman, Kang & Waimey PC

(57) ABSTRACT

A razor blade cartridge includes: a housing: a razor blade fixedly mounted in the housing including: an edge that is elongated in a direction orthogonal to shaving direction, the edge includes a cutting edge formed in a single arch and opposing rear and front faces, wherein the cutting edge extends along a longitudinal direction which is orthogonal to shaving direction; a connection portion extended and bent from the edge toward a direction orthogonal to the longitudinal direction and orthogonal to the shaving direction, the connection portion having faces continuous with the front and rear faces of the edge respectively; and a support portion extending from the connection portion in the direction orthogonal to both the longitudinal direction and the shaving direction, the support portion supporting the edge and the connection portion, the connection portion and the support portion are a single body.

20 Claims, 5 Drawing Sheets

Related U.S. Application Data continuation of application No. 13/132,077, filed on May 31, 2011, now Pat. No. 9,878,458, which is a continuation of application No. PCT/KR2010/000521, filed on Jan. 28, 2010.

(56) References Cited

U.S. PATENT DOCUMENTS 3,331,129 A * 7/1967 Goudie ..... B26B 21/18 30/49
3,587,171 A * 6/1971 Perry ..... B26B 21/26 30/40.1
4,459,744 A * 7/1984 Esnard ..... B26B 21/14 30/346.5
4,516,320 A * 5/1985 Peleckis ..... B26B 21/4018 30/49
4,603,477 A * 8/1986 Francis ..... B26B 21/56 30/346.56
4,621,424 A * 11/1986 Jacobson ..... B26B 21/225 30/41
4,720,917 A * 1/1988 Solow ..... B26B 21/4012 30/346.5
4,901,437 A * 2/1990 Iten ..... B26B 21/14 30/50
4,976,028 A * 12/1990 Chen ..... B26B 21/4012 30/49
4,980,974 A * 1/1991 Radcliffe ..... B26B 21/22 30/356
5,010,646 A * 4/1991 Neamtu ..... B26B 21/565 30/50
5,199,173 A * 4/1993 Hegemann ..... B26B 21/165 30/49
5,208,982 A * 5/1993 Ferruzza, Jr. ..... B26B 21/28 30/49
5,687,485 A 11/1997 Shurtleff et al.
5,704,127 A * 1/1998 Cordio ..... B26B 21/14 30/49
5,761,814 A 6/1998 Anderson et al.
5,956,848 A 9/1999 Tseng et al.
5,956,851 A 9/1999 Apprille et al.
6,041,926 A 3/2000 Petricca et al.
6,052,903 A 4/2000 Metcalf et al.
6,185,822 B1 2/2001 Tseng et al.
6,212,777 B1 4/2001 Gilder et al.
6,442,839 B1 9/2002 Tseng et al.
6,516,518 B1 2/2003 Garraway et al.
6,612,040 B2 9/2003 Gilder
6,684,513 B1 2/2004 Clipstone et al.
7,131,202 B2 * 11/2006 Pennell ..... B26B 21/565 30/50
7,210,229 B2 * 5/2007 Coffin ..... B26B 21/222 30/346.57
10,486,322 B2 11/2019 Park et al.
2002/0092175 A1 * 7/2002 Kameka ..... B26B 21/165 30/49
2003/0046819 A1 * 3/2003 Ferraro ..... B26B 21/521 30/527
2003/0204954 A1 * 11/2003 Wain ..... B26B 21/56 30/49
2004/0020053 A1 * 2/2004 Wain ..... B26B 21/227 30/50
2005/0102847 A1 * 5/2005 King ..... B26B 21/225 30/527
2006/0277760 A1 * 12/2006 Lee ..... B26B 21/22 30/50
2007/0124939 A1 6/2007 Van Eibergen Santhagens
2007/0163390 A1 * 7/2007 Hobbs ..... B26B 21/54 76/104.1
2007/0234577 A1 * 10/2007 Masek ..... B26B 21/54 30/346.55
2008/0022530 A1 * 1/2008 Royle ..... B26B 21/227 30/50
2008/0072431 A1 * 3/2008 Ozenick ..... B26B 21/40 30/50
2008/0196251 A1 * 8/2008 Royle ..... B26B 21/4012 30/50

* cited by examiner

[Fig. 1]
[Background Art]
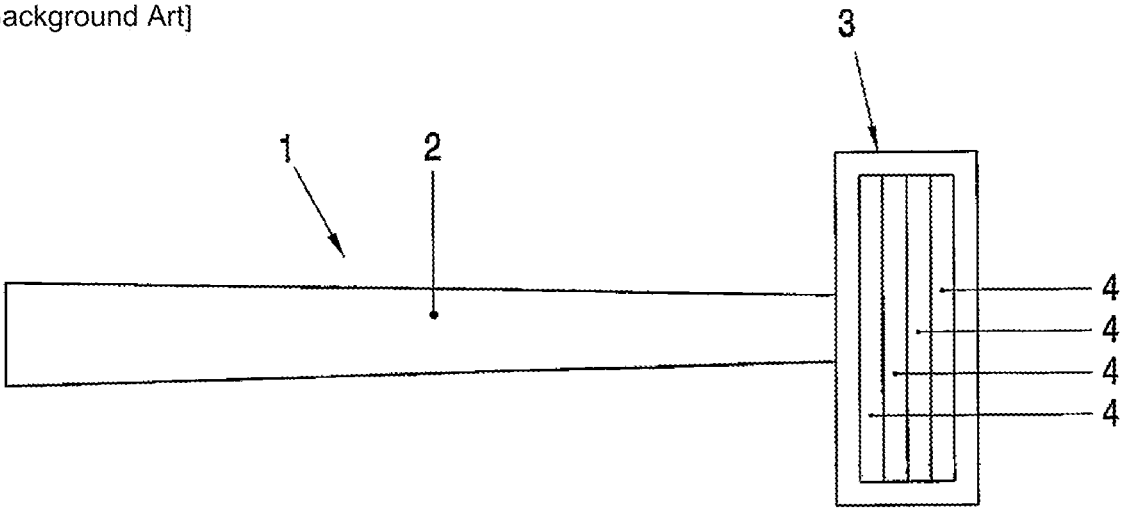
[Fig. 2] [Background Art]
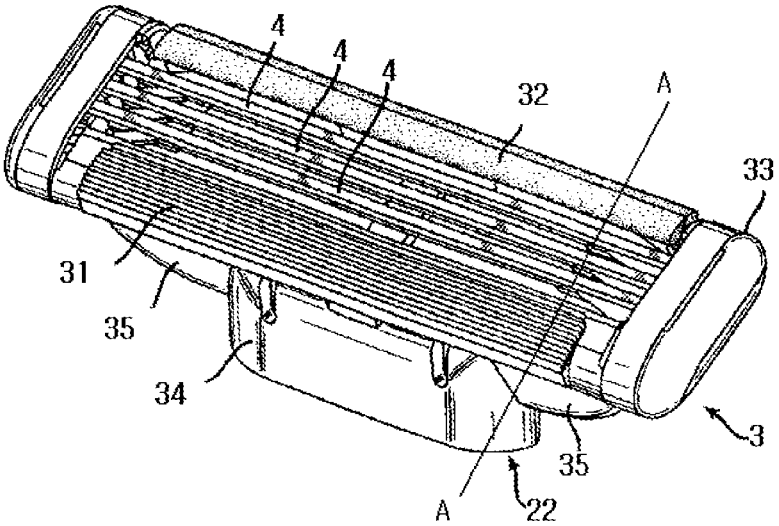

[Fig. 3]
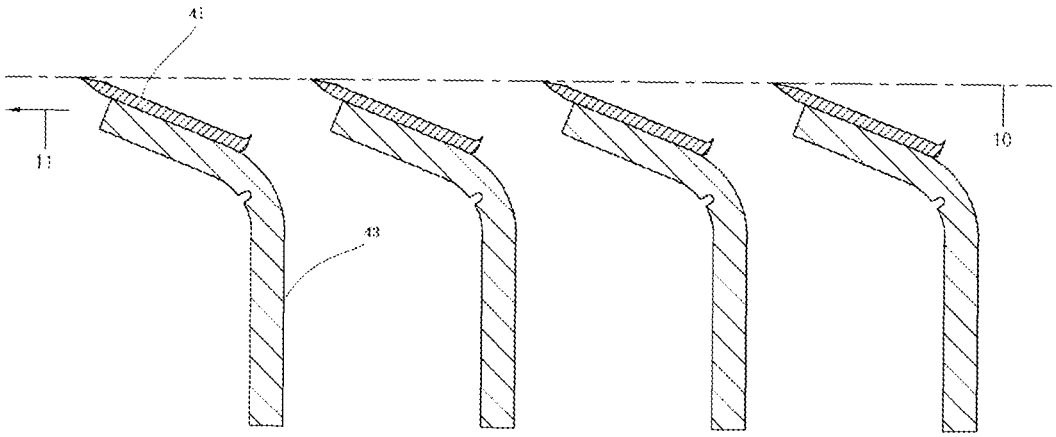
[Fig. 4]
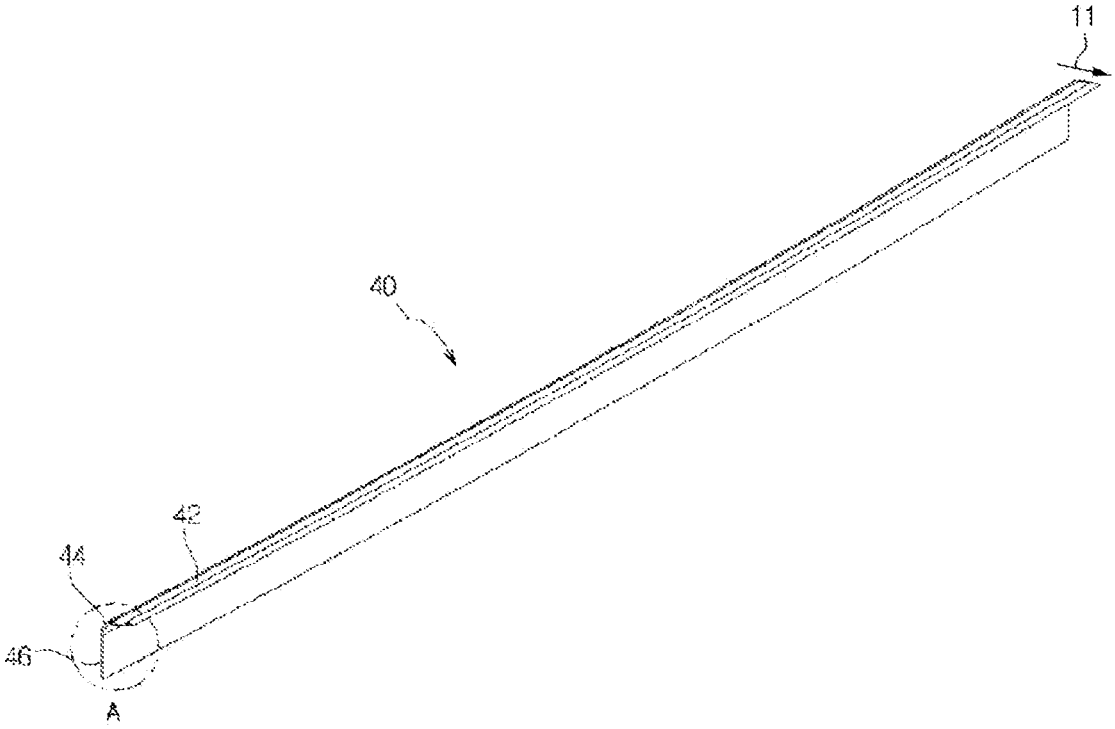

[Fig. 5]
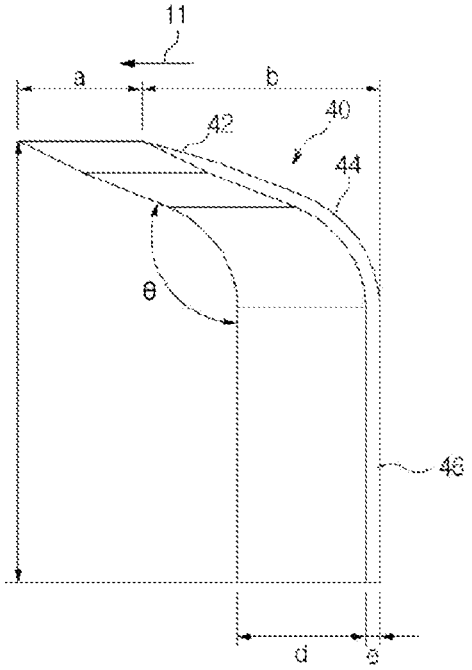
[Fig. 6]
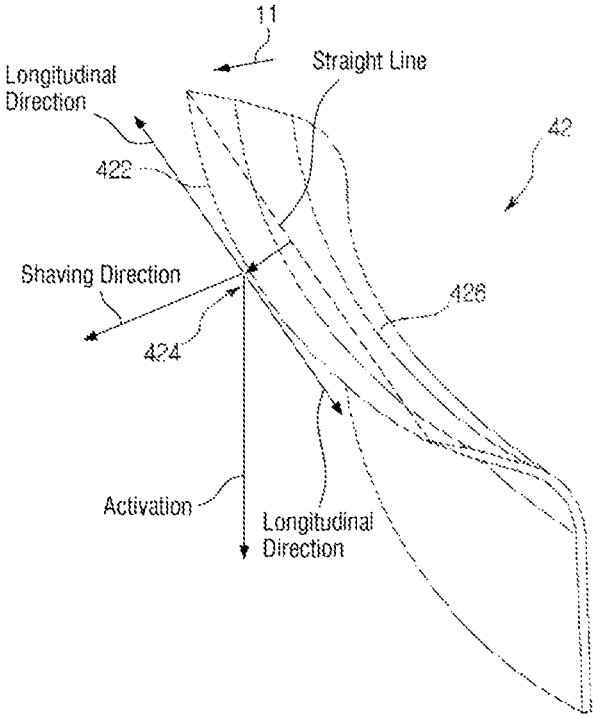

[Fig. 7]
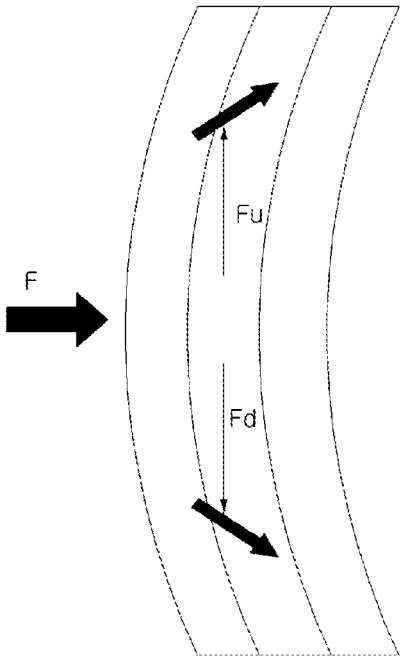
[Fig. 8]
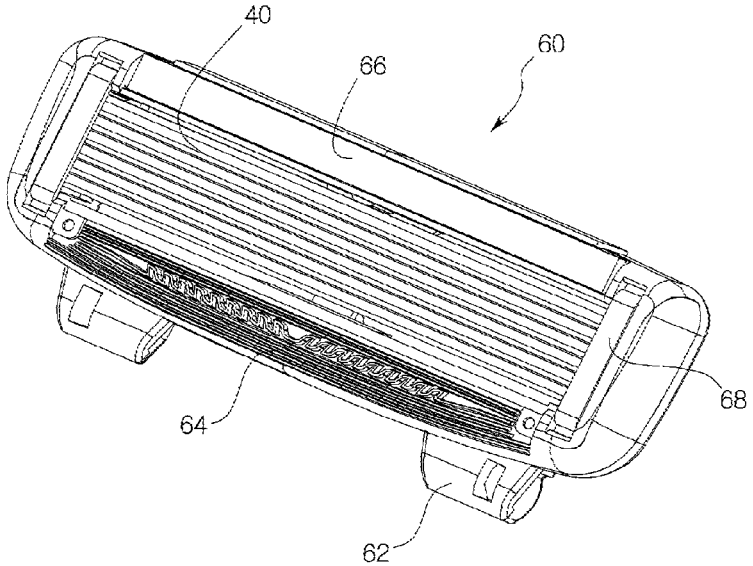

[Fig. 9]
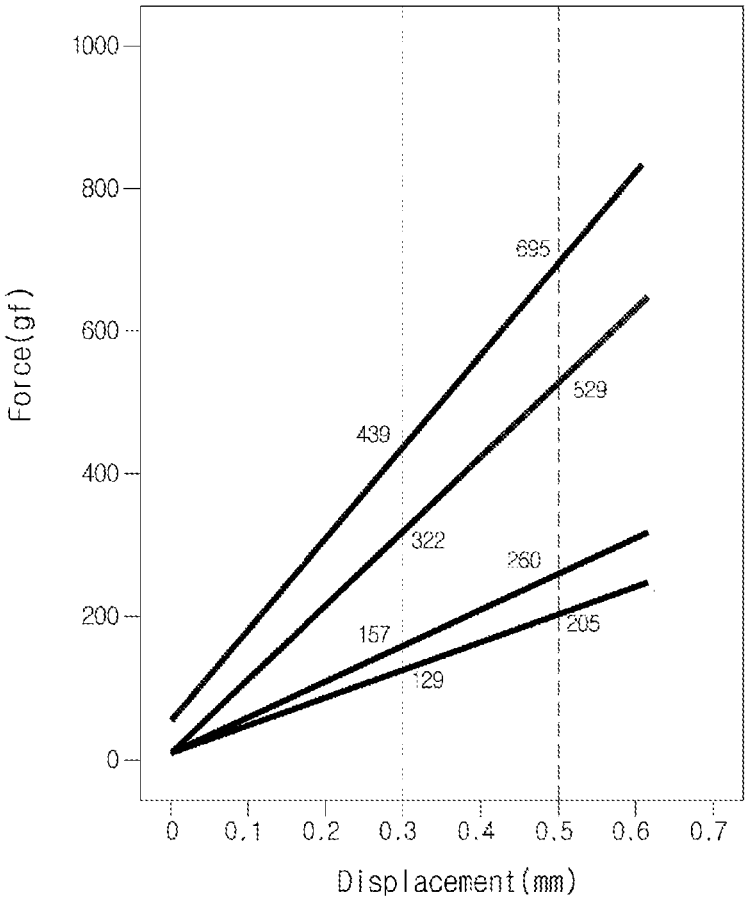

UNITARY RAZOR BLADE AND SHAVING RAZOR CARTRIDGE USING SAME

This application is a continuation application of U.S. patent application Ser. No. 15/845,331, filed Dec. 18, 2017, which is a continuation application of U.S. patent application Ser. No. 13/132,077, filed May 31, 2011, now U.S. Pat. No. 9,878,458, which is a continuation application of international application PCT/KR2010/000521, filed on Jan. 28, 2010, which claims benefit of earlier filing date and right of priority to Korean Patent Application No. 10-2009-0010877, filed on Feb. 11, 2009, the contents of which are all hereby incorporated by reference herein in their entirety.

BACKGROUND

Technical Field

The present invention relates to a unitary razor blade and a shaving razor cartridge using the same, and more particularly, to a razor blade which is shaped into a geometrical structure so as to achieve the maximized strength thereof.

Background Art

Shaving should give a sense of cleanness and avoid any cut or injury. Factors which affect the shaving performance include a frictional resistance between a razor blade edge and skin and the sharpness of the razor blade edge. Such factors include the force of a cutter applied to hair by the razor blade.

Increase in the number of razor blades in a shaving razor improves shaving efficiency of the shaving razor and well distributes a pressure to the skin, but also increases a drag force. Also, the increased number of razor blades takes more space or narrows the gap between cutting edges. Such increased area taken by the razor blades may adversely affect the shaving performance, and the narrower gap of the razor blades may deteriorate the shaving performance, and make it difficult to remove the shaving remainder. Conversely, if the gap between the razor blades is wider, the shaving performance may improve but users are more likely to be injured or cut by the razor blades. Accordingly, it is very important to properly adjust the gap between the razor blades.

To narrow the gap between the razor blades with the shaving performance secured and to remove the shaving remainder without difficulty, the thickness of the razor blades should be inevitably thin. However, if the razor blades are too thin, they cannot cut hair but may be easily deformed and deteriorate durability. Accordingly, it is required to provide a thin and strong razor blade.

As shown in FIGS. 1 and 2, a general wet shaving razor includes a grip 2, a cartridge 3 and a plurality of razor blades 4.

The cartridge 3 includes a housing 33 which accommodates therein the plurality of razor blades 4, a guard rubber 31 and a lubricant band 32. The cartridge 3 includes a connection portion 22 which is connected to the grip 2 so that the housing 33 rotates with respect to a rational shaft.

FIG. 3 is a sectional view of the cartridge 3, taken along line A-A' in FIG. 2. As shown therein, the razor blades 4 has a cutting edge 41 mounted on a supporter 43 to maintain a certain level of strength. Generally, the supporter 43 includes a strong aluminum alloy. That is, the cutting edge 41 is mounted on the supporter 43 by welding to prevent the razor blades 4 from being deformed or damaged when used.

The cutting edge 41 is located adjacently to a shaving direction 11 to reduce the risk of cut and ensure a comfortable shaving. An edge portion of the razor blades 4 is inclined at an acute angle to a shaving plan 10 to provide a comfortable shaving and prevents the cutting edge 41 to be worn to some extent.

However, the conventional technology requires a welding process to combine the cutting edge 41 and the supporter 43 which are manufactured in separate processes, incurring a lot of expenses and deteriorating manufacturing efficiency due to additional processes.

DISCLOSURE

Technical Problem

The present invention has been made to solve the problems and it is an object of the present invention to provide a thin and strong razor blade.

Another aspect of the present invention is to provide a razor blade in which a cutting edge and a supporter are combined into a single body and improves a manufacturing efficiency of the razor blade.

Further, another aspect of the present invention is to provide a razor blade and a shaving razor cartridge using the same, wherein the razor blade is shaped into a geometrical structure and distributes the pressure applied to skin when a user shaves.

Technical Solution

In order to achieve the object of the present invention, a razor blade comprises an edge portion which comprises a curved cutting edge; a connection portion which extends from the edge portion and forms a curved surface; and a support portion which extends from the connection portion and supports the edge portion and the connection portion, wherein the edge portion, the connection portion and the support portion are combined into a single body.

The edge portion comprises a rear portion that is concave.

The cutting edge protrudes in a circular shape and distributes a cutting pressure when hair is cut.

The distance from a central portion of the cutting edge to a straight line connecting opposite ends of the cutting edge ranges between 0.01 mm and 2.0 mm.

The distance from a central portion of the cutting edge to a straight line connecting opposite ends of the cutting edge is 0.2 mm.

The cutting edge protrudes in a circular shape and a radius of the circle ranges between 210 mm and 220 mm.

The thickness of the razor blade ranges between 0.075 mm and 0.2 mm.

In order to achieve the object of the present invention, a shaving razor cartridge comprises a housing; and a plurality of razor blades which comprises an edge portion mounted in the housing and comprising a curved cutting edge, a connection portion extending from the edge portion and forming a curved surface and a support portion extending from the connection portion and supporting the edge portion and the connection portion, wherein the edge portion, the connection portion and the support portion are combined into a single body.

The plurality of razor blades comprises two to ten razor blades.

The distance from the first razor blade to the last razor blade of the plurality of the razor blades ranges between 1.0 mm and 8.0 mm.

The distance between the plurality of razor blades ranges between 0.5 mm and 0.9 mm.

The edge portion comprises a rear portion that is concave.

The cutting edge protrudes in a circular shape and distributes a cutting pressure when hair is cut.

The distance from a central portion of the cutting edge to a straight line connecting opposite ends of the cutting edge ranges between 0.01 mm and 2.0 mm.

The distance from a central portion of the cutting edge to a straight line connecting opposite ends of the cutting edge is 0.2 mm.

The thickness of the razor blade ranges between 0.075 mm and 0.2 mm.

Advantageous Effect

A razor blade according to the present invention is thin and strong.

Also, a razor blade according to the present invention has a cutting edge and a supporter combined into a single body to improve manufacturing efficiency of the razor blade.

Further, a razor blade according to the present invention is shaped into a geometrical structure so as to achieve the maximized strength thereof.

Further, a razor blade according to the present invention is thin and removes the shaving remainder without difficulty.

BRIEF DESCRIPTION OF DRAWINGS

FIG. 1 illustrates a conventional shaving razor.

FIG. 2 illustrates a conventional shaving razor cartridge.

FIG. 3 is a sectional view of the shaving razor cartridge taken along line A-A' in FIG. 2.

FIG. 4 is a perspective view of a razor blade according to the present invention.

FIGS. 5 to 7 are enlarged views of the razor blade in FIG. 4.

FIG. 8 illustrates a shaving razor cartridge according to the present invention.

FIG. 9 is a graph which shows a strength test result of the razor blade according to the present invention and the conventional razor blade.

BEST MODE

Hereinafter, a detailed structure of a razor blade according to exemplary embodiments of the present invention will be described with reference to accompanying drawings.

FIG. 4 illustrates a razor blade according to an exemplary embodiment of the present invention.

Referring to FIG. 4, a razor blade 40 includes an edge portion 42 including a cutting edge 422 to cut hair, a connection portion 44 extending from the edge portion 42, and a support portion 46 extending from the connection portion 44 and supporting the razor blade 40, wherein the edge portion 42, the connection portion 44 and the support portion 46 are combined into a single body.

FIG. 5 is an enlarged view of a part A in FIG. 4. FIG. 6 is an enlarged view of the edge portion 42. FIG. 7 is a plan view of the razor blades 40.

As shown in FIG. 6, the edge portion 42 has a front portion 424 which is convex, and a rear portion 426 which is concave. If the razor blade is curved as above, the pressure applied to the cutting edge of the razor blade at the time of shaving is distributed and the razor blade can maintain its strength even in a thinner thickness to thereby prevent a deformation of the razor blade.

As shown in FIG. 7, if the force F is applied to the cutting edge 422, the forces Fu and Fd are distributed up and down along a curved surface, and thus the razor blade may maintain its strength even in a thinner thickness.

In FIG. 5, as the cutting edge 422 has a curved structure and the central portion of the razor blade protrudes, measures a and d are formed. Such measures depend on the entire length of the razor blade 40, and may range between 0.01 mm and 2.0 mm. If the razor blade 40 is 37.26 mm in length, the length of a and d is preferably about 0.2 mm. If a virtual starting point is set, a radius is 216.95 mm.

A distance from the cutting edge 422 to the support portion 46, i.e., a width b of the razor blades 40 may range between 1.0 mm and 3.0 mm, and preferably 1.8 mm. A height c of the razor blades 40 may range between 1.5 mm and 5.0 mm, and preferably 2.5 mm. A thickness e of the razor blades 40 may range between 0.05 mm and 0.2 mm, and preferably 0.075 mm.

The connection portion 44 may form an angle ranging between 90.degree. and 170.degree., and preferably 112.degree.

As described above, if a razor blades are used, the gap between the razor blades 40 preferably ranges between 0.5 mm and 0.9 mm. Since the razor blades are thin, such gap is enough to prevent the deterioration of the shaving performance and to remove the shaving remainder without difficulty.

That is, if the razor blades 40 are shaped into a curved surface as above, the thickness of the razor blades 40 may be thinner, and the gap between the razor blades 40 in a shaving razor having a plurality of razor blades may be narrowed and a remainder discharger of a shaving razor cartridge which discharges such remainder to the rear portion r thereof may be ensured.

FIG. 8 illustrates a shaving razor cartridge 60 in which the razor blades as above are mounted.

Referring to FIG. 8, the shaving razor cartridge 60 includes a housing 62, a guard rubber 64, a lubricant band 66, a clip 68, and the razor blades 40.

The housing 62 forms an external appearance of the shaving razor cartridge 60, and provides a structure to install the razor blades 40 therein. The housing 62 accommodates therein the guard rubber 64, the lubricant band 66 and the clip 68. The material of the housing 62 according to the present exemplary embodiment includes plastic, but not limited thereto, and may further include wood, metal or the like.

The guard rubber 64 is formed adjacently to the cutting edge of the razor blades 40, and allows the hair to stand so that the razor blades 40 cut the hair without difficulty.

The lubricant band 66 is installed in an opposite direction of the cutting edge of the razor blades 40 for the purposes of securing moisture of the skin and of smoothing the skin. The lubricant band 66 may include chamomile, olive, or allantoin ingredient so that a user may have a feeling of freshness after shaving.

The clip 68 is used to prevent the razor blades 40 from being separated from the housing 62.

FIG. 9 illustrates a performance test result of the razor blades according to the present invention and the conventional razor blades.

The razor blade according to the present invention is 0.075 mm in thickness (according to a first exemplary embodiment) and 0.1 mm (according to a second exemplary embodiment), and the conventional razor blade was products (product 1 and product 2) manufactured by company G currently sold in the market.

The test devices was Instron 5542 test machine of Instron.

In the graph, an abscissa refers to a degree of pressing the razor blade in the unit of mm and an ordinate refers to the force applied.

Referring to FIG. 9, the strength of the razor blade according to the first and second exemplary embodiments of the present invention is weaker than the product 2, but stronger than the product 1 of the company G. That is, even if the cutting edge and the supporter of the razor blade according to the present invention are combined into a single body unlike the conventional razor blade, the razor blade according to the present invention is stronger than the product 1 and is sufficient to be used as a razor blade.

The razor blade according to the present invention is weaker than the product 2, but is thin and excludes an additional razor blade supporter. In consideration of the foregoing, the razor blade according to the present invention is much stronger than the conventional razor blade. The products 1 and 2 are 0.15 mm or more in thickness.

Table 1 below shows repetitive test data.

TABLE 1

| Item | Product 1 | Product 2 | $1^{st}$ exemplary embodiment | $2^{nd}$ exemplary embodiment |
|---|---|---|---|---|
| 1 | 260 | 780 | 210 | 160 |
| 2 | 240 | 650 | 170 | 240 |
| 3 | 240 | 650 | 330 | 300 |
| 4 | 220 | 680 | 330 | 400 |
| 5 | 240 | 680 | 230 | 470 |
| Average | 240 | 688 | 264 | 314 |
| Standard deviation | 14.1 | 53.6 | 72.0 | 123.6 |

As in Table 1 above, the razor blade according to the present invention endures more load than the product 1 from company G and is strong enough to be used as a razor blade.

As described above, a razor blade according to the present invention is formed in a single body to thereby reduce manufacturing processes and realize a strength enough to be used as a razor blade.

What is claimed is:

1. A razor blade cartridge comprising:

a housing; and a plurality of blades mounted in the housing and each comprising:

an edge portion extending along a length of the blade;

a cutting edge disposed at the edge portion and extending along the length of the blade wherein the cutting edge is directed toward a shaving direction to cut hair in the shaving direction;

a connection portion supporting the edge portion; and a support portion extending from the connection portion and configured to support the connection portion, wherein the connection portion is bent between the edge portion and the support portion, wherein the cutting edge of each blade of the plurality of blades is convexly curved and extends past a straight line connecting opposite ends of the cutting edge at a rest position, and wherein the cutting edge of each blade of the plurality of blades has a substantially same degree of convex curvature at a rest position.

2. The razor blade cartridge according to claim 1, wherein the plurality of razor blades comprises two to ten razor blades.

3. The razor blade cartridge according to claim 1, wherein a distance from a first razor blade to a last razor blade of the plurality of the razor blades ranges between 1.0 mm and 8.0 mm.

4. The razor blade cartridge according to claim 1, wherein a distance between each of the plurality of razor blades ranges between 0.5 mm and 0.9 mm.

5. The razor blade cartridge according to claim 1, wherein the connection portion and the support portion are formed as an integrated body.

6. The razor blade cartridge according to claim 1, wherein a distance from a central portion of the cutting edge to the straight line connecting opposite ends of the cutting edge ranges between 0.01 mm and 2.0 mm for each of the plurality of blades.

7. The razor blade cartridge according to claim 1, wherein a distance from a central portion of the cutting edge to the straight line connecting opposite ends of the cutting edge is 0.2 mm for each of the plurality of blades.

8. The razor blade cartridge according to claim 1, wherein a thickness of each of the plurality of blades is substantially the same and ranges between 0.075 mm and 0.2 mm.

9. The razor blade cartridge according to claim 1, wherein the convexly curved cutting edge of each of the plurality of blades is configured to distribute a cutting pressure along the convex curvature of the blade when hair is cut.

10. A razor blade cartridge comprising:

a housing;

a plurality of blades wherein each blade comprises:

an edge portion that is elongated in a longitudinal direction orthogonal to a shaving direction;

a cutting edge extending along the longitudinal direction wherein the cutting edge is directed toward the shaving direction to cut hair in the shaving direction;

a connection portion supporting the edge portion and bent from the edge portion toward a direction orthogonal to the longitudinal direction and orthogonal to the shaving direction; and a support portion extending from the connection portion in the direction orthogonal to both the longitudinal direction and the shaving direction, wherein the connection portion and the support portion are formed as an integrated body, wherein the cutting edge of each blade of the plurality of blades is convexly curved toward the shaving direction from a straight line connecting opposite ends of the cutting edge at a rest position, and wherein the cutting edge of each blade of the plurality of blades has a substantially same degree of convex curvature towards the shaving direction at the rest position.

11. The razor blade cartridge according to claim 10, wherein the plurality of razor blades comprises two to ten razor blades.

12. The razor blade cartridge according to claim 10, wherein a distance from a first razor blade to a last razor blade of the plurality of the razor blades ranges between 1.0 mm and 8.0 mm.

13. The razor blade cartridge according to claim 10, wherein a distance between each of the plurality of razor blades ranges between 0.5 mm and 0.9 mm.

14. The razor blade cartridge according to claim 10, wherein a distance from a central portion of the cutting edge to the straight line connecting opposite ends of the cutting edge ranges between 0.01 mm and 2.0 mm for each of the plurality of blades.

15. The razor blade cartridge according to claim 10, wherein a distance from a central portion of the cutting edge to the straight line connecting opposite ends of the cutting edge is 0.2 mm for each of the plurality of blades.

16. The razor blade cartridge according to claim 10, wherein a thickness of each blade of the plurality of blades ranges between 0.075 mm and 0.2 mm.

17. The razor blade cartridge according to claim 10, further comprising a guard disposed at the housing adjacent to the plurality of blades.

18. The razor blade cartridge according to claim 10, further comprising a lubricant band disposed at the housing adjacent to the plurality of blades and positioned in front of a leading blade of the plurality of blades with respect to the shaving direction.

19. The razor blade cartridge according to claim 10, further comprising a clip configured to secure the plurality of blades to the housing.

20. The razor blade cartridge of claim 10, wherein the convexly curved cutting edge of each of the plurality of blades is configured to distribute a cutting pressure along the convex curvature of the blade when hair is cut.

* * * * *